US008887680B2

(12) United States Patent
Hayman et al.

(10) Patent No.: US 8,887,680 B2
(45) Date of Patent: Nov. 18, 2014

(54) ENGINE ASSEMBLY INCLUDING MODIFIED CAMSHAFT ARRANGEMENT

(75) Inventors: Alan W. Hayman, Romeo, MI (US); Rodney E. Baker, Fenton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 556 days.

(21) Appl. No.: 13/012,128

(22) Filed: Jan. 24, 2011

(65) Prior Publication Data

US 2012/0186544 A1 Jul. 26, 2012

(51) Int. Cl.

| | |
|---|---|
| ***F01L 1/00*** | (2006.01) |
| ***F01L 1/053*** | (2006.01) |
| ***F02B 75/22*** | (2006.01) |
| ***F01L 1/047*** | (2006.01) |
| ***F01L 1/24*** | (2006.01) |
| ***F01L 1/14*** | (2006.01) |
| ***F01L 1/18*** | (2006.01) |
| *F01L 1/344* | (2006.01) |

(52) U.S. Cl.

CPC ..... *F02B 75/22* (2013.01); *F01L 2001/34496* (2013.01); *F01L 1/053* (2013.01); *F01L 1/047* (2013.01); *F01L 1/2422* (2013.01); *F01L 1/146* (2013.01); *F01L 1/181* (2013.01); *F01L 1/344* (2013.01); *F01L 1/24* (2013.01); *F01L 1/2405* (2013.01); *F01L 1/185* (2013.01); *F01L 1/14* (2013.01)

USPC ..... 123/90.41; 123/90.27; 123/90.43; 123/90.6

(58) Field of Classification Search

CPC ..... F02B 75/22; F01L 1/047; F01L 1/053; F01L 1/14; F01L 1/146; F01L 1/185; F01L 1/24; F01L 1/2405; F01L 1/2422; F01L 1/344; F01L 1/181; F01L 2001/34496

USPC ..... 123/90.6, 90.27, 90.1, 90.12, 90.15, 123/90.16, 90.17, 90.31, 90.39, 90.44, 123/90.41, 90.43

See application file for complete search history.

(56) References Cited

U.S. PATENT DOCUMENTS

| | | | | |
|---|---|---|---|---|
| 1,711,882 | A * | 5/1929 | Fornaca | 123/59.6 |
| 3,316,890 | A * | 5/1967 | Turkish | 123/90.27 |
| 4,660,527 | A * | 4/1987 | Tanaka et al. | 123/41.82 R |
| 6,505,592 | B1 * | 1/2003 | Hayman et al. | 123/90.61 |
| 7,836,858 | B2 * | 11/2010 | Maehara et al. | 123/90.16 |
| 2006/0260575 | A1 * | 11/2006 | Buelna | 123/90.16 |
| 2008/0127916 | A1 * | 6/2008 | Burgess et al. | 123/54.4 |
| 2009/0241869 | A1 * | 10/2009 | Burgess et al. | 123/54.4 |

* cited by examiner

*Primary Examiner* — Thomas Denion
*Assistant Examiner* — Jason T Newton
(74) *Attorney, Agent, or Firm* — Harness, Dickey & Pierce, P.L.C.

(57) ABSTRACT

An engine assembly includes an engine block having a first bank defining a first cylinder bore and a second bank defining a second cylinder bore. A first cylinder head is coupled to the first bank and defines first and second ports in communication with the first cylinder bore. A second cylinder head is coupled to the second bank and defines a third port in communication with the second cylinder bore. A first valve is located in the first port and engaged with a first valve lift mechanism, a second valve is located in the second port and engaged with a second valve lift mechanism, and a third valve is located in the third port and engaged with a third valve lift mechanism. A first camshaft is engaged with the first and third valve lift mechanisms and a second camshaft is engaged with the second valve lift mechanism.

11 Claims, 4 Drawing Sheets

ENGINE ASSEMBLY INCLUDING MODIFIED CAMSHAFT ARRANGEMENT

FIELD

The present disclosure relates to engine camshaft arrangements.

BACKGROUND

This section provides background information related to the present disclosure which is not necessarily prior art.

Internal combustion engines may combust a mixture of air and fuel in cylinders and thereby produce drive torque. Combustion of the air-fuel mixture produces exhaust gases. Engines may include intake ports to direct and air flow to the combustion chambers and exhaust ports to direct exhaust gases from the combustion chambers. Camshafts are used to displace intake and exhaust valves between open and closed positions to selectively open and close the intake and exhaust ports.

SUMMARY

An engine assembly may include an engine block, a first cylinder head, a second cylinder head, first, second and third valves, first, second and third valve lift mechanisms, a first camshaft and a second camshaft. The engine block may include a first bank defining a first cylinder bore and a second bank defining a second cylinder bore disposed at an angle relative to the first cylinder bore. The first cylinder head may be coupled to the first bank of the engine block and may define a first port in communication with the first cylinder bore and a second port in communication with the first cylinder bore. The second cylinder head may be coupled to the second bank of the engine block and may define a third port in communication with the second cylinder bore. The first valve may be located in the first port, the second valve may be located in the second port, and the third valve may be located in the third port. The first valve lift mechanism may be engaged with the first valve, the second valve lift mechanism may be engaged with the second valve, and the third valve lift mechanism may be engaged with the third valve. The first camshaft may be engaged with the first valve lift mechanism and the third valve lift mechanism. The second camshaft may be engaged with the second valve lift mechanism.

In another arrangement, an engine assembly may include an engine block, a first cylinder head, a second cylinder head, a first camshaft, a second camshaft, and a third camshaft. The engine block may include a first bank defining a first cylinder bore and a second bank disposed at an angle relative to the first bank and defining a second cylinder bore. The first cylinder head may be coupled to the first bank of the engine block and the second cylinder head may be coupled to the second bank of the engine block. The first camshaft may be rotationally supported by the engine block between the first and second cylinder bores. The second camshaft may be rotationally supported on the first cylinder head and the third camshaft may be rotationally supported on the second cylinder head.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
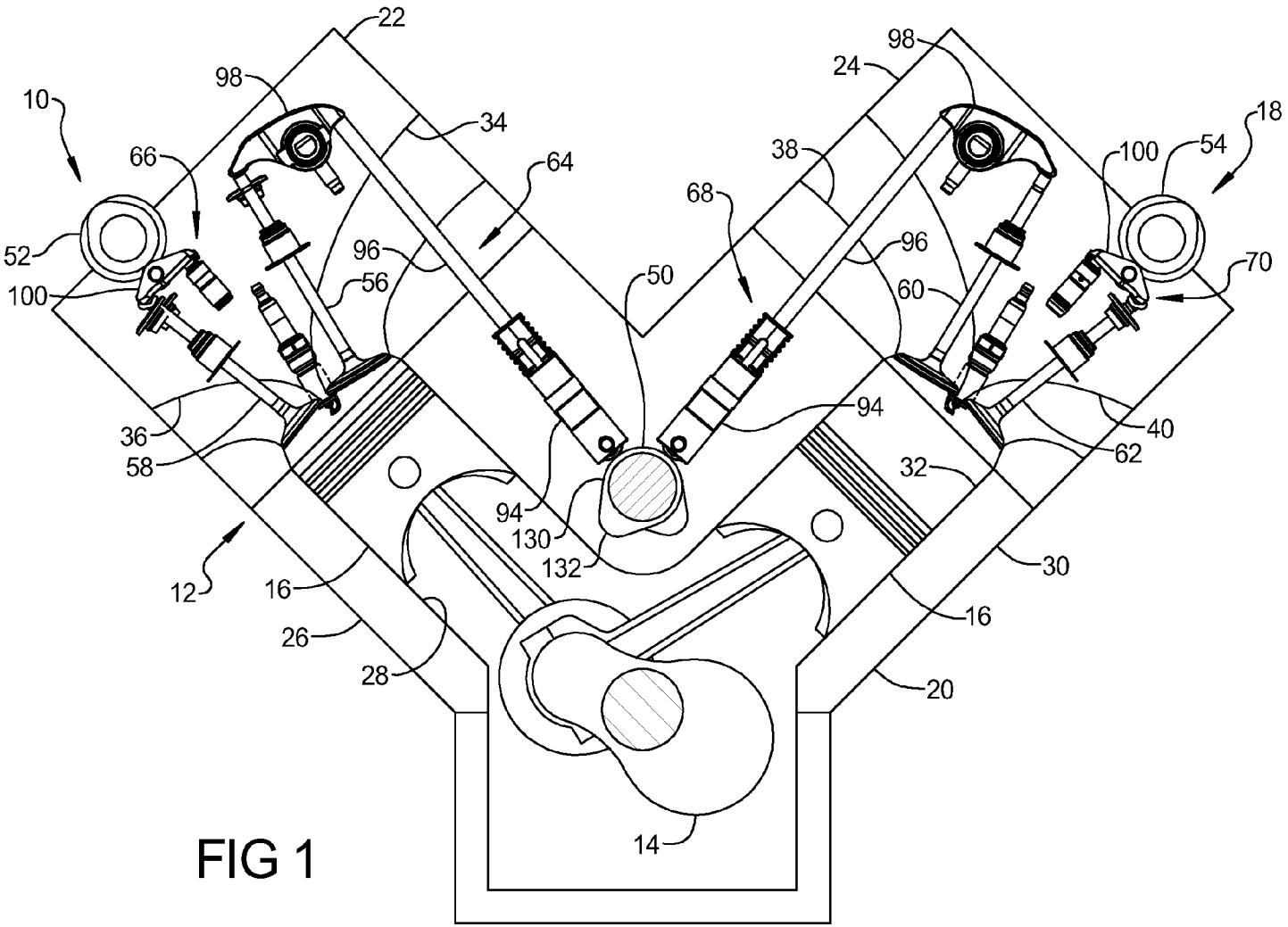
FIG. 1 is a schematic section illustration of an engine assembly according to the present disclosure.
Figure 2:
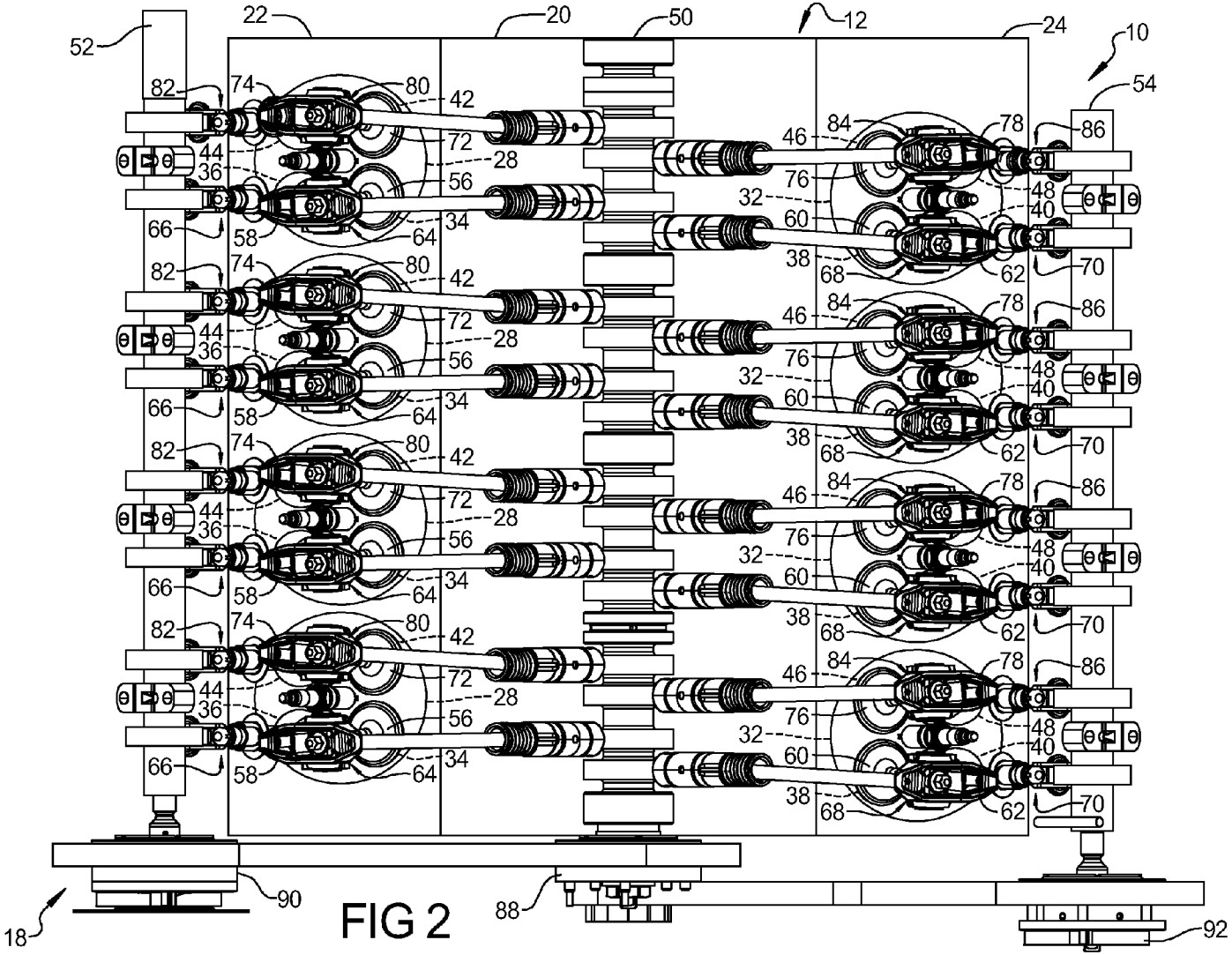
FIG. 2 is a schematic top view of the engine assembly of FIG. 1.

An engine assembly 10 is illustrated in FIGS. 1 and 2 and may include an engine structure 12, a crankshaft 14, pistons 16 and a valvetrain assembly 18. The engine structure 12 may include an engine block 20, a first cylinder head 22 and a second cylinder head 24. The engine block 20 may include a first bank 26 defining first cylinder bores 28 and a second bank 30 defining second cylinder bores 32 extending at an angle relative to the first bank 26 and forming a V-configuration.

The engine assembly 10 will be described with respect to one of first cylinder bores 28 and one of second cylinder bores 32 for simplicity with understanding that the description applies equally to the remainder of the first and second cylinder bores 28, 32. As seen in FIG. 1, the first cylinder head 22 may be coupled to the first bank 26 of the engine block 20 and may define a first port 34 in communication with the first cylinder bore 28 and a second port 36 in communication with the first cylinder bore 28. The second cylinder head 24 may be coupled to the second bank 30 of the engine block 20 and may define a third port 38 in communication with the second cylinder bore 32 and a fourth port 40 in communication with the second cylinder bore 32. In the present non-limiting example, the first port 34 forms a first intake port for the first cylinder bore 28, the second port 36 forms a first exhaust port for the first cylinder bore 28, the third port 38 forms a first intake port for the second cylinder bore 32 and the fourth port 40 forms a first exhaust port for the second cylinder bore 32. As seen in FIG. 2, the present non-limiting example allows the use of a four valve arrangement, where the first cylinder head 22 additionally defines a second intake port 42 and a second exhaust port 44 in communication with the first cylinder bore 28 and the second cylinder head 24 also defines a second intake port 46 and a second exhaust port 48 in communication with the second cylinder bore 32.

The valvetrain assembly 18 may include first, second and third camshafts 50, 52, 54, first, second, third and fourth valves 56, 58, 60, 62, and first, second, third and fourth valve lift mechanisms 64, 66, 68, 70. The first valve 56 may be located in the first port 34 and may define a first intake valve for the first cylinder bore 28 and the second valve 58 may be located in the second port 36 and may define a first exhaust valve for the first cylinder bore 28. The third valve 60 may be located in the third port 38 and may define a first intake valve for the second cylinder bore 32 and the fourth valve 62 may be located in the fourth port 40 and may define a first exhaust valve for the second cylinder bore 32.

The first valve lift mechanism 64 may be engaged with the first valve 56, the second valve lift mechanism 66 may be engaged with the second valve 58, the third valve lift mechanism 68 may be engaged with the third valve 60 and the fourth valve lift mechanism 70 may be engaged with the fourth valve 62. The first camshaft 50 may be engaged with the first valve lift mechanism 64 and the third valve lift mechanism 68. The second camshaft 52 may be engaged with the second valve lift mechanism 66 and the third camshaft 54 may be engaged with the fourth valve lift mechanism 70.

In the exemplary four valve arrangement illustrated in FIG. 2, the valvetrain assembly 18 may additionally include a second intake valve 72 located in each of the second intake ports 42 defined in the first cylinder head 22 and a second exhaust valve 74 located in each of the second exhaust ports 44 defined in the first cylinder head 22. Similarly, the valvetrain assembly 18 may additionally include a second intake valve 76 located in each of the second intake ports 46 defined in the second cylinder head 24 and a second exhaust valve 78 located in each of the second exhaust ports 48 defined in the second cylinder head 24.

An additional valve lift mechanism 80 (similar to the first valve lift mechanism 64) may be engaged with the second intake valve 72 and the first camshaft 50 and an additional valve lift mechanism 82 (similar to the second valve lift mechanism 66) may be engaged with the second exhaust valve 74 and the second camshaft 52. Similarly, an additional valve lift mechanism 84 (similar to the third valve lift mechanism 68) may be engaged with the second intake valve 76 and the first camshaft 50 and an additional valve lift mechanism 86 (similar to the fourth valve lift mechanism 70) may be engaged with the second exhaust valve 78 and the third camshaft 54.

In the present non-limiting example, the first camshaft 50 is rotationally supported by the engine block 20 between the first and second cylinder bores 28, 32. More specifically, the first and second banks 26, 30 may form a V-configuration as indicated above with the first camshaft 50 located within a central region of the V-configuration. The first port 34 and the third port 38 may each be located on an inboard side of the first and second cylinder heads 22, 24 and may extend toward the central region of the V-configuration formed by the engine block 20. The second intakes ports 42, 46 may additionally be located on the inboard side of the first and second cylinder heads 22, 24 and may extend toward the central region of the V-configuration formed by the engine block 20.

The second camshaft 52 may be rotationally supported on the first cylinder head 22 and the third camshaft 54 may be rotationally supported on the second cylinder head 24. As seen in FIG. 2, a first cam phaser 88 may be coupled to the first camshaft 50, a second cam phaser 90 may be coupled to the second camshaft 52 and a third cam phaser 92 may be coupled to the third camshaft 54. The location of the first camshaft 50 and first cam phaser 88 provided by the present disclosure may provide for a lower profile intake manifold arrangement than is typically available on four valve engines.

As seen in FIG. 1, the first valve lift mechanism 64 may include a lifter 94 engaged with the first camshaft 50, a pushrod 96 engaged with the lifter 94, and a rocker arm 98 engaged with the pushrod 96 and the first valve 56. The third valve lift mechanism 68 may also include a lifter 94 engaged with the first camshaft 50, a pushrod 96 engaged with the lifter 94, and a rocker arm 98 engaged with the pushrod 96 and the third valve 60. The second valve lift mechanism 66 may include a rocker arm 100 engaged with the second camshaft 52 and the second valve 58. The fourth valve lift mechanism 70 may also include a rocker arm 100 engaged with the third camshaft 54 and the fourth valve 62.

The first camshaft 50 may be located below the second and third camshafts 52, 54. More specifically, the first camshaft 50 may be located below the first and second cylinder heads 22, 24 and below the first and third valves 56, 60. The second camshaft 52 may be located above the first cylinder head 22 and the second valve 58. The third camshaft 54 may be located above the second cylinder head 24 and the fourth valve 62.

Figure 3:
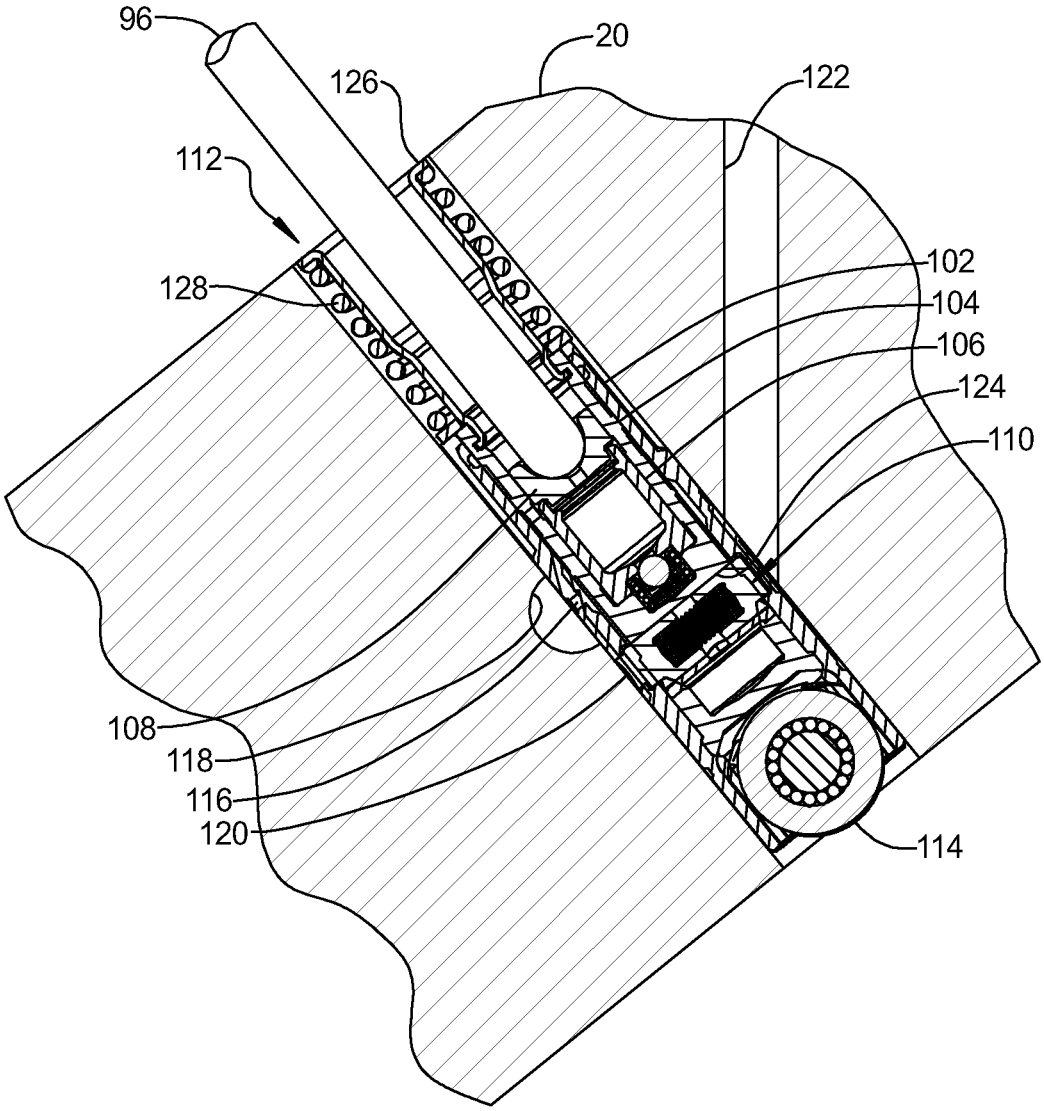
FIG. 3 is a fragmentary section view of the engine assembly of FIG. 1.

As seen in FIG. 3, the first and third valve lift mechanisms 64, 68 may each be operable in a first mode and a second mode. The lifter 94 may include a lifter body 102, a housing member 104, a plunger 106, a pushrod seat 108 engaged with the pushrod 96, a locking mechanism 110, a lost motion mechanism 112 and a cam follower 114 coupled to the lifter body 102. The lifter body 102 may be located in the engine block 20 and may include a first opening 116 in communication with a first oil passage 118 and a second opening 120 in communication with a second oil passage 122. The first opening 116 may provide pressurized oil flow to the plunger 106 and the plunger 106 may form a hydraulic lash adjuster to maintain engagement between the pushrod 96 and the pushrod seat 108.

The housing member 104 may form a lock pin housing defining an opening 124 containing the locking mechanism 110 therein. While described in combination with a deactivating lift mechanism, it is understood that the present disclosure applies equally to a variety of other switchable valve lift mechanisms as well as fixed lift mechanisms (i.e., non-switchable valve lift mechanisms). The locking mechanism 110 may include first and second locking pins and a biasing member (not shown). The biasing member may force the locking pins radially outward from one another.

The first and second locking pins may be displaceable between locked and unlocked positions by selectively providing pressurized oil to the second oil passage 122. In the locked position, the first and second locking pins fix the pushrod 96 for displacement with the lifter body 102. In the unlocked position, the first and second locking pins allow relative displacement between the pushrod 96 and the lifter body 102.

The lost motion mechanism 112 may include a retaining member 126 and a biasing member 128. The retaining member 126 may be axially fixed to the housing member 104 and the biasing member 128 may engage the retaining member 126 and the lifter body 102, biasing the cam follower 114 into engagement with the a cam lobe 130 of the first camshaft 50. The cam lobe 130 may displace the lifter body 102 toward the retaining member 126 against the force of the biasing member 128 as a peak 132 of the cam lobe 130 engages the cam follower 114. The lifter body 102 may be returned to an initial position by the biasing member 128 as a base region 134 of the cam lobe 130 engages the cam follower 114.

When the first and second locking pins are in the locked position, the cam lobe 130 of the first camshaft 50 may displace the housing member 104, and therefore the pushrod 96, with the housing member 104 to open the first valve 56 based on an engagement between the peak 132 of the cam lobe 130 and the cam follower 114. When the first and second locking pins are in the unlocked position, the lifter body 102 may be displaced relative to the housing member 104 when the cam follower 114 is engaged with the peak 132 of the cam lobe 130, preventing opening of the first valve 56.

Figure 5:
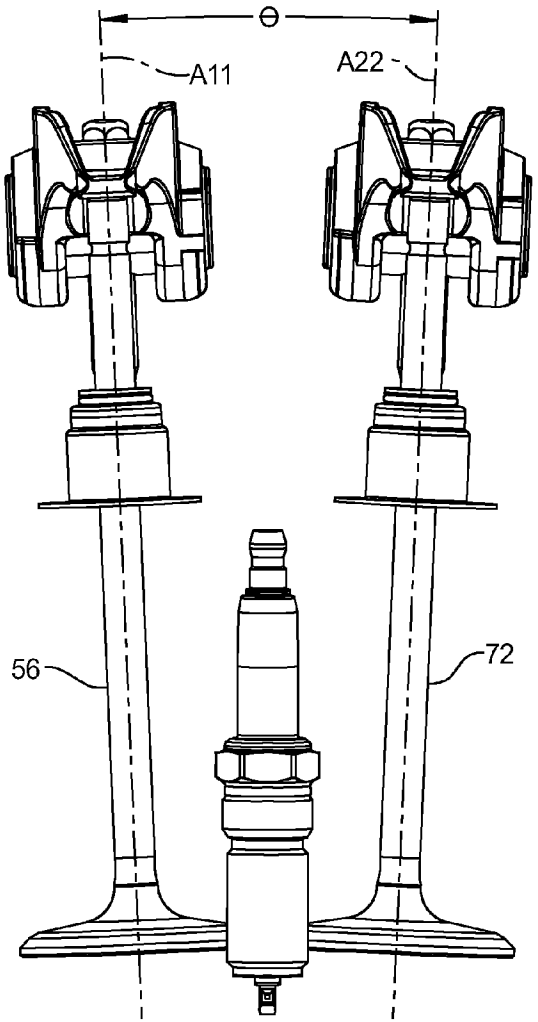
FIG. 5 is a plan view of a second valve arrangement of the engine assembly shown in FIG. 1.
Figure 4:
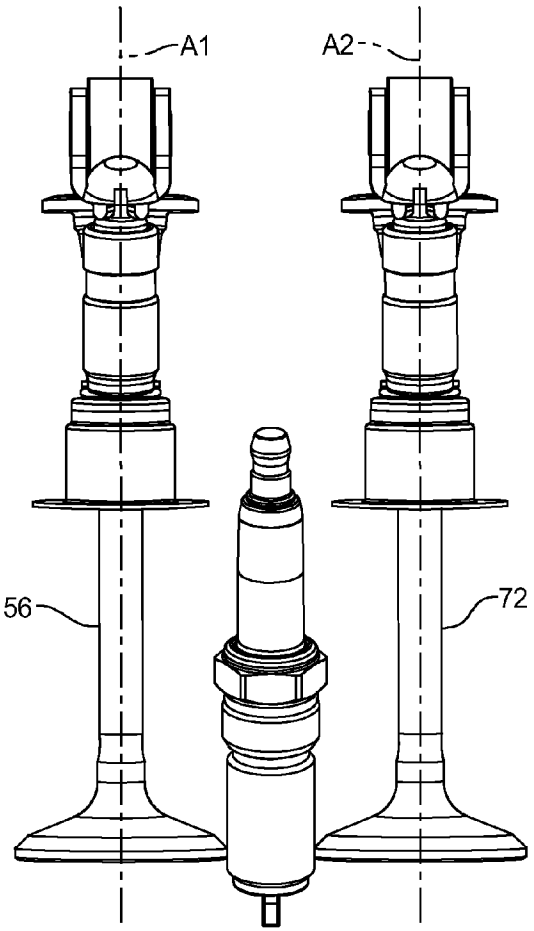
FIG. 4 is a plan view of a first valve arrangement of the engine assembly shown in FIG. 1.

In a first non-limiting example, seen in FIG. 4, the first valve 56 (first intake valve) and the second intake valve 72 may be disposed parallel to one another (i.e., defining parallel axes of reciprocation—first axis A1 and second axis A2). However, the camshaft arrangement described in the present disclosure provides for an alternate arrangement for the first valve 56 (first intake valve) and the second intake valve 72 shown in FIG. 5 (i.e., a splayed valve arrangement). In the splayed valve arrangement, the first valve 56 (first intake valve) and the second intake valve 72 may be disposed at an angle (θ) relative to one another (i.e., defining axes of reciprocation A11, A22 disposed at angle (θ) relative to one another). The splayed arrangement on a four valve engine may provide for larger valve sizes than are normally available on typical four valve engines. While described with respect to the first valve 56 (first intake valve) and the second intake valve 72 of the first cylinder head 22, it is understood the valve orientations discussed above apply equally to the third valve 60 (first intake valve) and the second intake valve 76 of the second cylinder head 24.

What is claimed is:

1. An engine assembly comprising:

an engine block including a first bank defining a plurality of first cylinder bores and a second bank defining a plurality of second cylinder bores disposed at an angle relative to the plurality of first cylinder bores;

a first cylinder head coupled to the first bank of the engine block and defining a plurality of first ports in communication with the plurality of first cylinder bores and a plurality of second ports in communication with the plurality of first cylinder bores;

a second cylinder head coupled to the second bank of the engine block and defining a plurality of third ports in communication with the plurality of second cylinder bores and a plurality of fourth ports in communication with the plurality of second cylinder bores;

a plurality of first valves located in the plurality of first ports, a plurality of second valves located in the plurality of second ports, a plurality of third valves located in the plurality of third ports and a plurality of fourth valves located in the plurality of fourth ports;

a plurality of first valve lift mechanisms engaged with the plurality of first valves, a plurality of second valve lift mechanisms engaged with the plurality of second valves, a plurality of third valve lift mechanisms engaged with the plurality of third valves and a plurality of fourth valve lift mechanisms engaged with the plurality of fourth valves;

a first camshaft supported by the engine block between the plurality of first and second cylinder bores below the plurality of first and third valves and engaged with the plurality of first valve lift mechanisms and the plurality of third valve lift mechanisms;

a second camshaft supported by said first cylinder head above the plurality of second valves and engaged with the plurality of second valve lift mechanisms; and a third camshaft supported by said second cylinder head above the plurality of fourth valves and engaged with the plurality of fourth valve lift mechanisms.

2. The engine assembly of claim 1, wherein the plurality of first valves and the plurality of third valves form intake valves.

3. The engine assembly of claim 2, wherein the plurality of first ports and the plurality of third ports extend toward a central region of the engine block defined between the plurality of first cylinder bores and the plurality of second cylinder bores.

4. The engine assembly of claim 1, wherein the plurality of first ports form a plurality of first intake ports and the first cylinder head defines a plurality of second intake ports in communication with the plurality of first cylinder bores.

5. The engine assembly of claim 4, wherein the plurality of first valves form a plurality of first intake valves defining a first axis for reciprocation and the engine assembly includes a plurality of second intake valves located in the plurality of second intake ports defining a second axis for reciprocation disposed at an angle relative to the first axis.

6. The engine assembly of claim 4, wherein the plurality of second ports form a plurality of first exhaust ports and the first cylinder head defines a plurality of second exhaust ports in communication with the plurality of first cylinder bores.

7. The engine assembly of claim 4, further comprising a first cam phaser coupled to the first camshaft.

8. The engine assembly of claim 7, further comprising a second cam phaser coupled to the second camshaft, and a third cam phaser coupled to the third camshaft.

9. The engine assembly of claim 1, wherein the plurality of first valve lift mechanisms are operable in a first mode providing a first valve lift when engaged by a cam lobe on the first camshaft and a second mode providing a second valve lift less than the first valve lift when engaged by the cam lobe.

10. The engine assembly of claim 1, wherein the first and second banks form a V-configuration with the first camshaft located within a central region of the V-configuration.

11. The engine assembly of claim 1, wherein the plurality of first valve lift mechanisms include a pushrod and the second valve lift mechanisms include a pushrod.

* * * * *